US006682341B2

(12) United States Patent
Pan et al.

(10) Patent No.: US 6,682,341 B2
(45) Date of Patent: Jan. 27, 2004

(54) CHILD RESISTANT ACTUATOR FOR PIEZOELECTRIC LIGHTER

(75) Inventors: Song Lin Pan, Walnut, CA (US); Lily Liu, Hicksville, NY (US)

(73) Assignee: L.A. Lighter Inc, City of Industry, CA (US)

( * ) Notice: Subject to any disclaimer, the term of this patent is extended or adjusted under 35 U.S.C. 154(b) by 0 days.

(21) Appl. No.: 10/171,204

(22) Filed: Jun. 15, 2002

(65) Prior Publication Data

US 2002/0192612 A1 Dec. 19, 2002

Related U.S. Application Data

(60) Provisional application No. 60/298,656, filed on Jun. 15, 2001.

(51) Int. Cl.[7] ..... F23D 11/36

(52) U.S. Cl. ..... 431/153; 431/255; 431/129

(58) Field of Search ..... 431/129–132, 431/134, 135, 137, 139, 140, 143, 151–153, 255

(56) References Cited

U.S. PATENT DOCUMENTS 3,603,709 A * 9/1971 Retzler ..... 431/131
3,724,993 A * 4/1973 Goto ..... 431/255
3,734,680 A * 5/1973 Maruyama ..... 431/132
3,814,571 A * 6/1974 Goto ..... 431/132
3,817,691 A * 6/1974 Tatsumi ..... 431/255
3,883,289 A * 5/1975 Fujioka ..... 431/131
4,022,566 A * 5/1977 Goto ..... 431/132
4,487,570 A * 12/1984 Lowenthal ..... 431/130
5,531,591 A * 7/1996 Yamazaki ..... 431/153
2002/0061487 A1 * 5/2002 Huang ..... 431/132
2002/0110768 A1 * 8/2002 Sher ..... 431/153
2002/0115031 A1 * 8/2002 Chen ..... 431/153
2002/0132201 A1 * 9/2002 Zhang ..... 431/153

* cited by examiner

*Primary Examiner*—Henry Bennett
*Assistant Examiner*—Kathryn Odland

(57) ABSTRACT

A piezoelectric lighter with a child resistant ignition mechanism which prevents accidental ignition and ignition by unintended users and by minor children under the age of 5 years. The safety ignition mechanism is an activation device that requires two displacements in order to ignite the lighter. The displacements are achieved by applying a continuous and increasing force to the activating component in order to ignite the lighter. The first displacement unlocks the ignition device and the second displacement initiates simultaneously an electrical discharge and a fuel discharge, which results in a flame. Whenever a user discontinues the application of force to the activating component, the ignition mechanism returns to an inoperable, locked position. The effectiveness of this activating device in resisting the manipulations of children under the age of 5 years has been established by tests performed pursuant to the requirements of the United States Consumer Product Safety Commission.

4 Claims, 6 Drawing Sheets

CHILD RESISTANT ACTUATOR FOR PIEZOELECTRIC LIGHTER

CROSS-REFERENCE TO RELATED APPLICATION

This is the continuation for application No. 60/298,656 filed on Jun. 15, 2001

BACKGROUND OF THE INVENTION

1. Field of the Invention

The present invention relates to a piezoelectric lighter with an ignition system adapted to prevent minor children, especially under the age of 5 years, from igniting the lighter, as well as preventing accidental and unintentional ignition by adults.

2. Background Art

In the past decade, disposable lighters using a piezoelectric mechanism have increasingly become common in the cigarette lighter industry. The United States Consumer Product Safety Commission has recognized that disposable lighters present an unacceptable danger to the public as a result of over 100 deaths resulting from accidental fires caused by minor children handling cigarette lighters in the home. As a result, the Commission has implemented regulations requiring child safety devices on all disposable cigarette lighters.

Various measures to prevent accidental and unintentional ignition of piezoelectric and other cigarette lighters by increasing the difficulty of activation, i.e., ignition, have been employed. In both the push down (i.e. vertical depression) and slide down (i.e., pivotable) type of ignition devices, a common method has been the use of ignition mechanisms that must be unlocked before ignition can occur. These inventions use various means to block, i.e., lock, the ignition device and require at least two separate and/or simultaneous manipulations to unlock and initiate the ignition process. Examples of such mechanisms are shown in U.S. Pat. Nos. 5,531,591; 5,439,375; 5,645,414; 5,584,682; 5,636,979; 6,200,130; 6,206,689; 6,299,434; 6,382,960; and 6,386,860. The disadvantage of these child safe devices are several. The devices are relatively complex in structure and require a number of component parts, thereby increasing the frequency of breakdowns of the locking device. If the child safe aspect of the lighter is lost, the lighter can be ignited accidentally and by children. Also, lighters with lock devices that must be manipulated separately or simultaneously with an activation device are awkward and more difficult to operate than child resistant lighters that require only one manipulation to achieve both objectives.

Another child resistant method used with the push down type of lighter is the use of activating mechanism that require the use of force (thumb pressure) that is normally beyond the ability of minor children to employ (at least 10 lbs of force). An example of such a mechanism (utilizing springs located within the activating device and or the gas release assembly) is illustrated In U.S. Pat. No. 6,267,582.

However, since springs lose their tension over time and use, and require a consistent calibration in production to maintain quality control, this method has serious drawbacks in maintaining a lighter's child resistant condition and is more costly to produce.

There is, however, a need for additional techniques of making piezoelectric lighters safe from manipulation by children and accidental ignition, while accommodating and conforming the endless number of creative styles and novel constructions of cigarette lighters.

The present invention provides a child resistant, safety device that combines both of the commonly employed concepts described above—an activating device that must be unlocked and one that requires force beyond the normal capabilities of minor children or mere accidental pressure. However, the use of a locking or latch element or similar parts is dispensed with, as well as the reliance on springs to provide resistance to activation. Rather, both objectives are achieved by the present invention by means of a simplified, integrally molded child resistant activating device adapted to a piezoelectric lighter with a standard means of gas release and piezoelectric ignition. Moreover, the present invention is user-friendly since it is operated in the conventional and traditional manner—by continuous downward pressure of the thumb—and does not require two or more digital manipulations to unlock and then ignite the lighter.

SUMMARY OF THE INVENTION

The object of this invention is to provide a piezoelectric cigarette lighter that is resistant to operation by minor children, that is safe from accidental and unintentional ignition, and that can be operated by intended users in the conventional manner. Accordingly, several objects and advantages of the present invention over the prior art are:

a) To provide a child resistant activation device that must be unlocked before ignition takes place and also requires force beyond that which can be employed by a minor child of 5 years or younger;

b) To provide a child resistant activation device that is user-friendly requiring only one (1) manipulation to achieve two (2) displacements which, first, unlocks the activation device and then, secondly, initiates the ignition mechanisms:

c) To provide a child resistant activation device that automatically returns to a static, locked condition after ignition is terminated and cannot be accidentally ignited;

d) To provide a simplified child resistant activation device that does not use a complex arrangement of several parts and elements (for example, latch elements, lock elements with springs, separate lock members, blocking elements, press buttons, and similar locking elements), that can easily break down;

e) To provide a child resistant activation device with a simplified construction and design that integrates the locking, unlocking, and ignition systems in the most economical and cost effective way;

f) To provide a child resistant activation device which, if it becomes inoperable, renders the lighter inoperable;

g) To provide a child resistant activation device that can be adapted to the greatest range of piezoelectric lighter embodiments in the art.

The invention is embodied in a standard piezoelectric lighter with an elongated outer body casing defining a fuel reservoir enclosed by an inner casing, a fuel dispensing assembly consisting of a fuel line with a valve that regulates the flow of fuel to a burner atop the fuel assembly. The fuel line is wrapped with a coiled spring to provide resistance to a gas lever that opens the valve. The outer body casing also houses a telescopic piezoelectric unit set in a piezoelectric unit casing. The inner telescopic portion of the piezoelectric unit is fitted at the top with a cap with opposite sidewalls forming flaps that extend downward. The flaps articulate with and rest above the pronged end of a gas lever that extends from the fuel line valve to the bottom portion of the piezoelectric unit. When the upper, telescopic part of the piezoelectric unit is pressed downward, it telescopes within the larger bottom portion of the unit and an electric spark is emitted into the area of the burner via a spark conductor. Simultaneously, the gas lever fitted to the valve is rotated upward, opening the valve and releasing fuel into the burner through the fuel line when the flaps of the piezoelectric unit cap press downward on the pronged end of the gas lever fitted to the piezoelectric unit, creating a see-saw movement that rotates the other end of the gas lever upward. At that end, the gas lever rests on a fulcrum post and is similarly fitted to the fuel line beneath the valve by means of two prongs. This process results in a controllable flame. When the downward force on the gas lever prongs fitted to the piezoelectric unit ceases or lessens, the coiled spring wrapping the fuel line drives that end of the gas lever downward to its original resting position, thereby closing the valve and terminating the flow of fuel The top of the lighter is defined by a middle casing which houses the burner and upper portion of the fuel dispensing assembly. The middle casing also serves as a wind-guard. Atop the middle casing is the child-safe activating device, an actuator consisting of a top cap with two molded, integrally formed connecting arms that extend downward on both sides of a middle post. The upper part of the connecting arms has molded, integrally formed finger-like projections that rest on the cap fitted atop the piezoelectric unit when assembled. The lower, free ends of the connecting arms are configured to define elongated, angled slots. The connecting arms are connected on opposite ends of the middle post by a connecting rod running through the middle post to the angled slots. When pressure is applied to the top cap, sliding it downward, the connecting arms pivot on the connecting rod, rotating the connecting arm slots to a vertical position. This displacement permits a further rotation of the top cap (i.e., unlocks the ignition, or cocks the ignition); further downward pressure on the top cap activates the ignition system as the pressure is translated to the piezoelectric unit through the action of finger-like projections resting above or on the piezoelectric unit cap.

Thus, in order to activate the ignition system, the user must apply a continuous and increasing pressure to the top cap to move the connecting arms to actuation position that will allow downward pressure to be placed on the piezoelectric unit cap which will initiate the ignition systems. This first displacement moves the angled slot of the connecting arms to a vertical position and the connecting rod to the top of the slot. The second displacement—the ignition process described hereinabove—can then occur.

This child-safe activating device heightens resistance to minor children as a result of the force necessary to unlock or cock the connecting arms and the additional force necessary to activate the piezoelectric unit and release the fuel. The effectiveness of this safety feature has been established by certification with the United States Consumer Product Safety Commission.

BRIEF DESCRIPTION OF THE DRAWINGS

FIG. 6 is an enlarged partial cross-section view of a lighter with the present child-safe actuator showing the lighter at rest in a locked, inoperative state and the position of the actuator and the connecting arm slot at that stage.

FIGS. 7 and 8 are enlarged partial cross-section views of a lighter embodying the present child-safe top cap actuator which together illustrates a sliding, rotative movement of the top cap that causes a first displacement which unlocks the actuator and readies it for ignition, wherein the elongated slot in the connecting arms rotates to a vertical position perpendicular to the connecting rod resting at the lower end of the slot, making possible a depression of the actuator to ignite the lighter.

DETAILED DESCRIPTION OF THE INVENTION

Although a specific embodiment of the present invention will now be described with reference to the drawings, the following description is only one example of a variety of specific embodiments representative of the principles of the present invention. Various changes and modifications obvious to one skilled in the art pertaining to the present invention are deemed to be within the spirit, scope and contemplation of the present invention as further defined in the appended claims.

Figure 1:
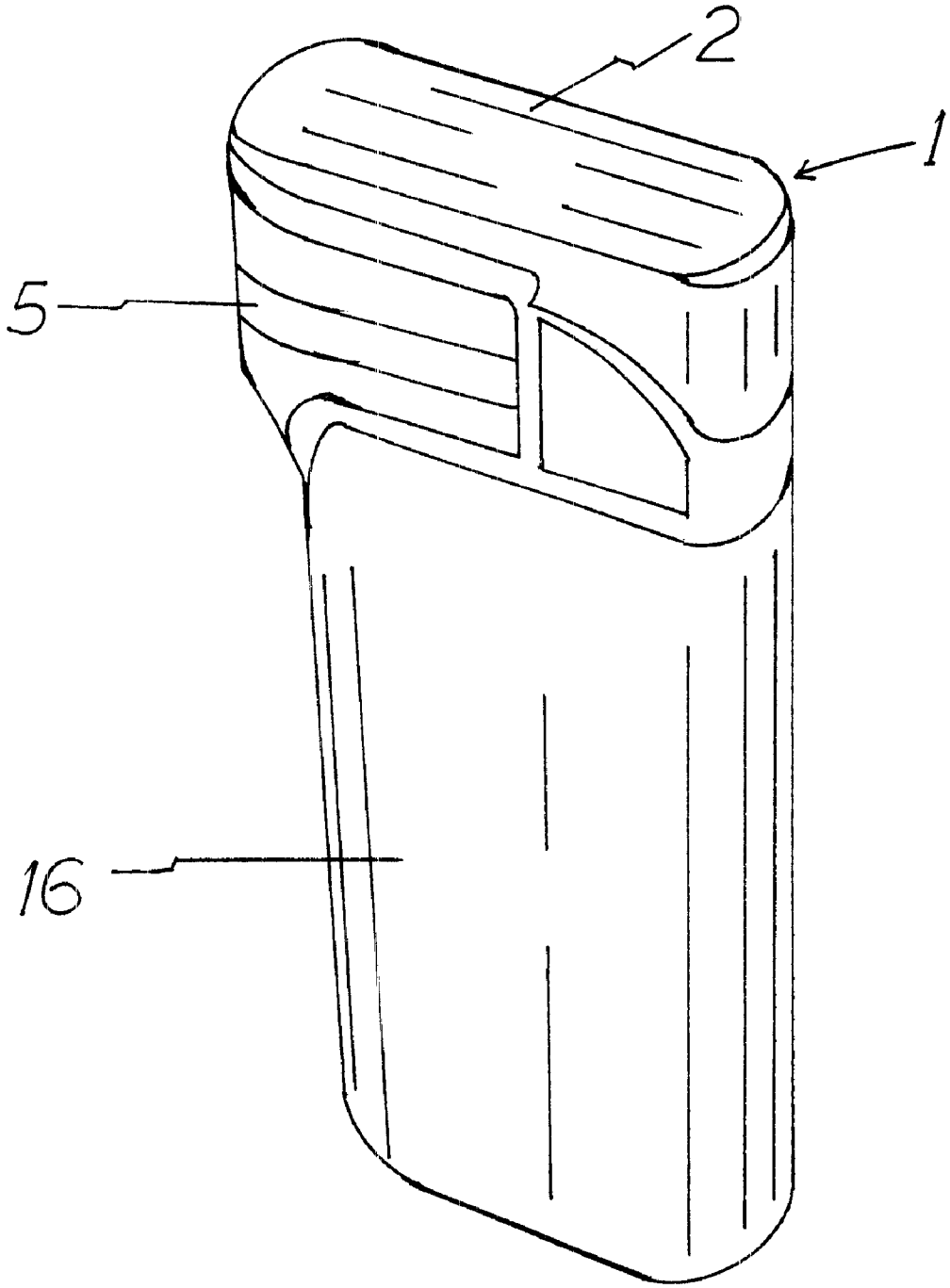
FIG. 1 is a perspective view of a standard piezoelectric cigarette lighter embodying the present child-safe actuator.

FIG. 1 depicts a preferred embodiment of a standard piezoelectric cigarette lighter with the present child-safe device. It shows an attractive exterior consisting of three parts—a top cap 2, middle casing 5 and the bottom outer casing 16.

Figure 2:
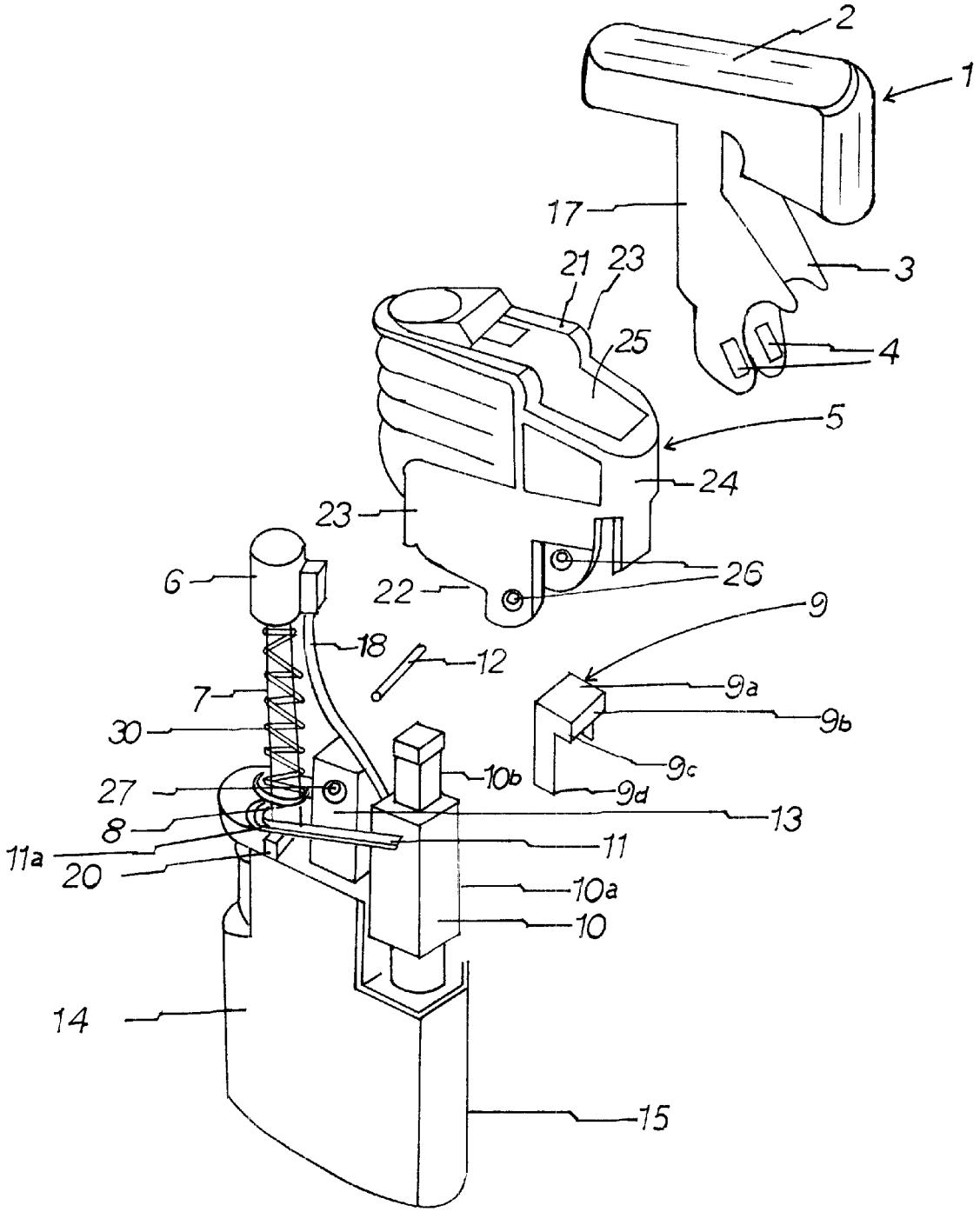
FIG. 2 is an enlarged, exploded, rear, perspective view of the lighter in FIG. 1 showing the child-safe top cap/actuator, the middle casing, and the construction of the internal components of the lighter, including the fuel assembly, fuel reservoir, and the piezoelectric unit.
Figure 6:
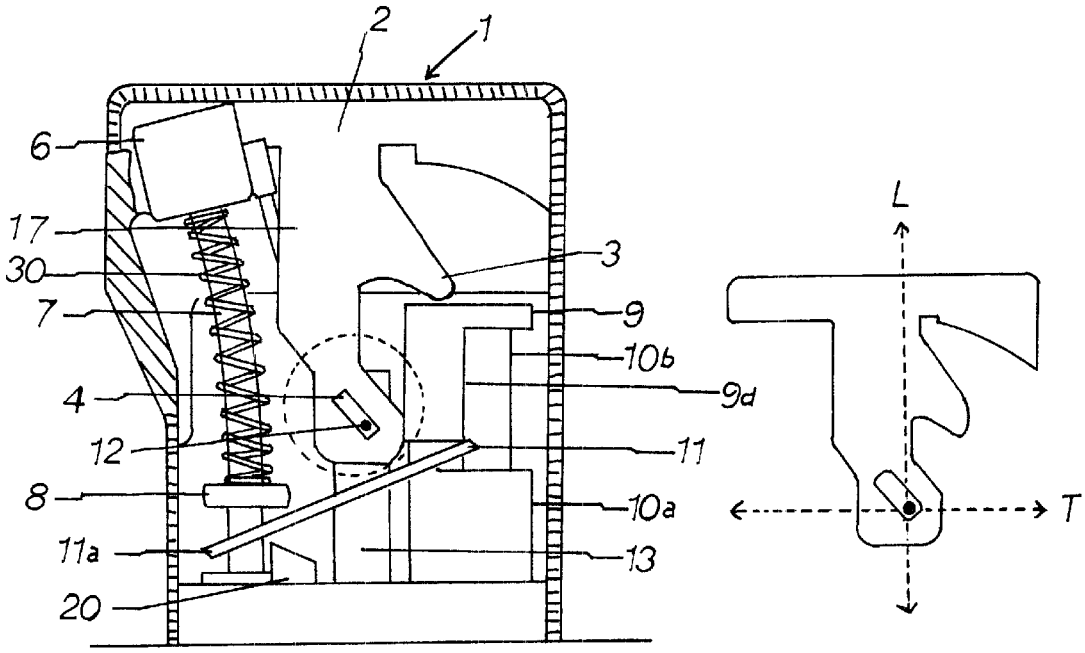
FIGS. 6 to 8 are enlarged partial cross section, longitudinal views of a lighter with the present invention, showing the operation of the lighter and the action of the top cap/child-safe actuator in sequence.
Figure 7:
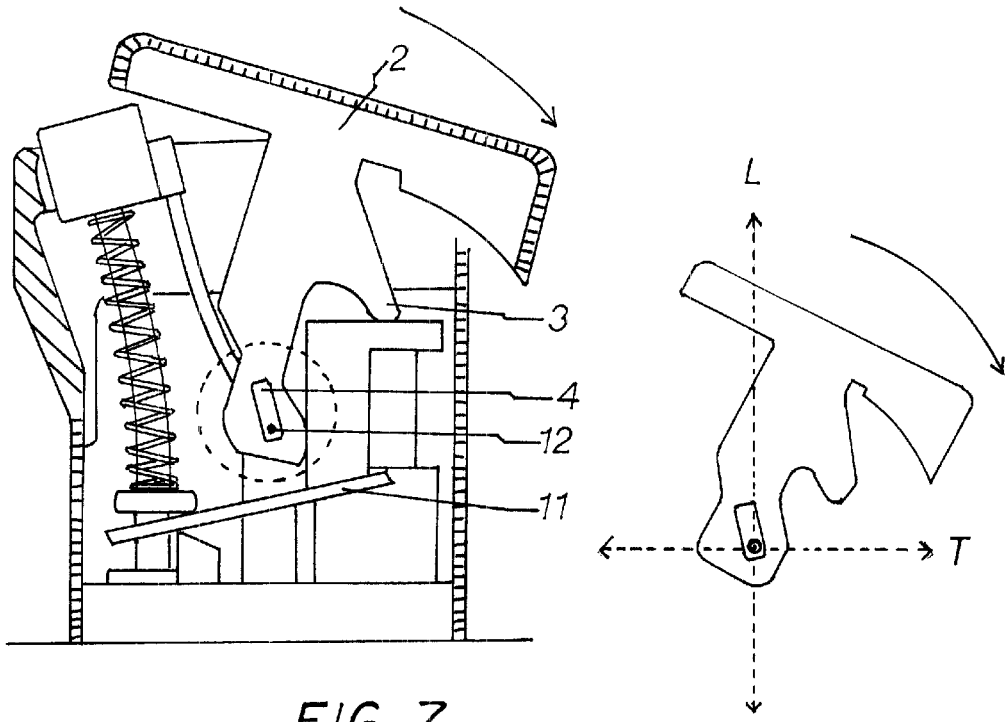
Figure 8:
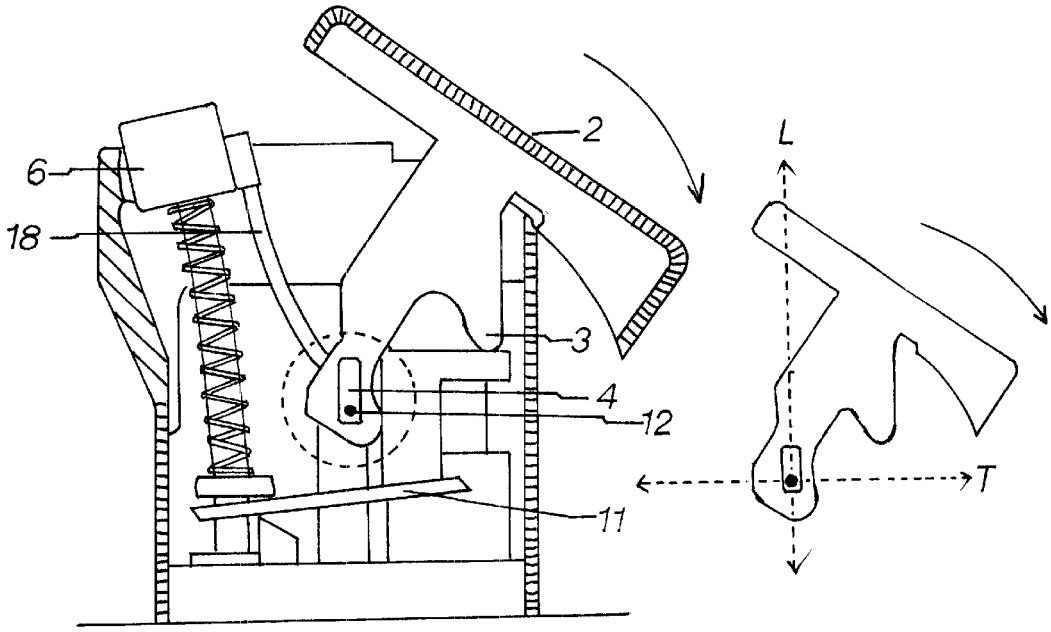

FIG. 2 is an exploded, perspective view of the lighter in FIG. 1. It displays the child-safe actuator 1, which is composed of the top cap 2 and connecting arms integrally formed perpendicular to the opposite side walls of the cap 17. The free ends of the connecting arms 17 are configured at a slight angle and define an elongated, angled cavity or slot 4 which receives the connecting rod 12 thereby movably connecting the connecting arms to the middle post 13, which is a solid structure defining an aperture 27 for receiving the connecting rod 12. This can be seen on FIGS. 2 and 4. The angled, elongated slots 4 provides a slidable channel for the connecting rod which serves as a pivot for the rotation of the activator 1, as illustrated in FIGS. 6, 7, and 8. On the upper portion of the connecting arms 17 on the distal edge are integrally formed finger projections 3 configured and dimensioned so as to rest on the top surface of the piezoelectric cap 9 when the lighter is assembled, as illustrated in FIG. 4

Figure 3:
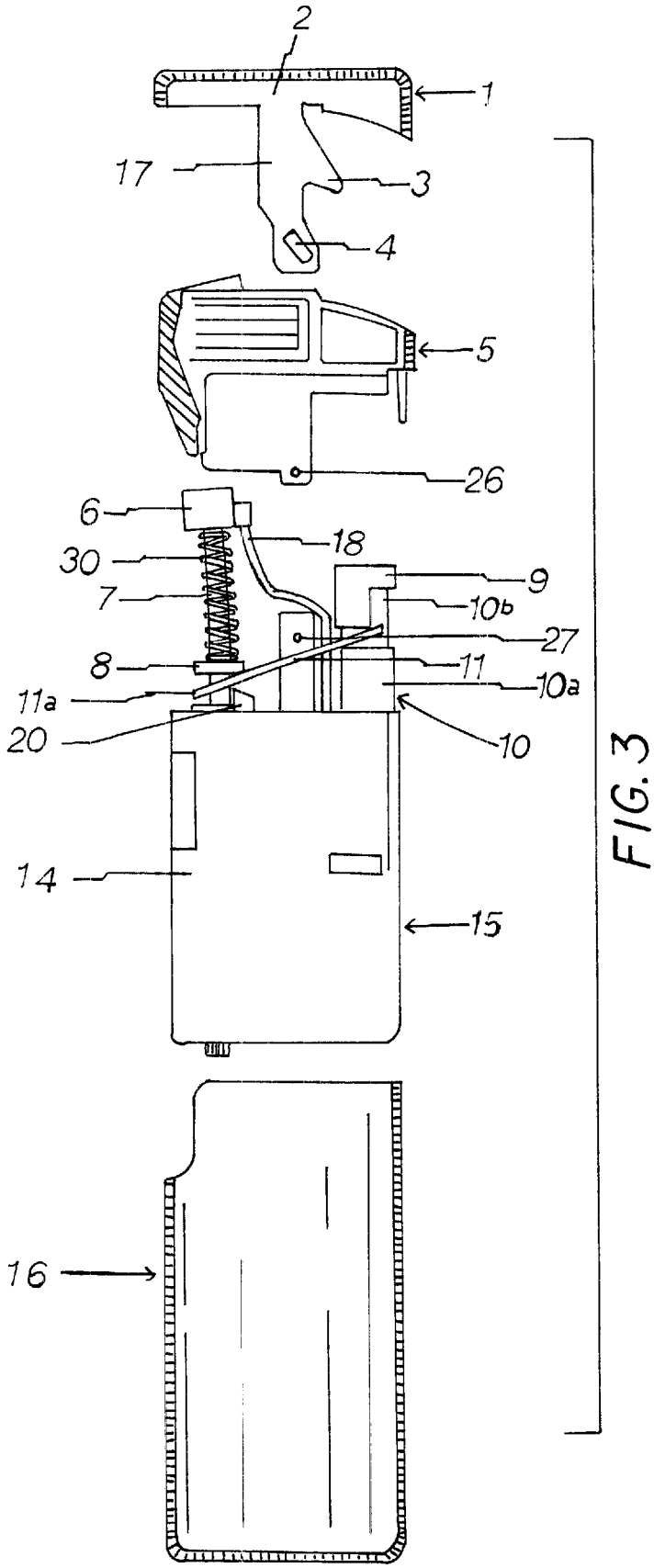
FIG. 3 is an enlarged exploded side view of the lighter in FIG. 1 showing the top cap/child-safe actuator; the middle casing; a partial cross section of the internal components of the lighter in FIG. 1, including the fuel assembly, fuel reservoir, the piezoelectric unit, and the bottom outer casing.

As illustrated by FIG. 3 the actuator 1 is mounted on the middle casing 5, which can also be seen in FIG. 2. The middle casing 5 acts as a windguard and houses the burner 6, the connecting arms 17 and the middle post 13 in this specific embodiment of the invention. In this embodiment, the middle casing 5 has a top 21 and a bottom 22, opposite sidewalls 23, and proximal and distal end walls 24 which together form a cavity 25 to receive the connecting arms 17 when the actuator 1 is mounted on the middle casing 5. The bottom of the sidewalls 23 of the middle casing 5 define apertures 26 to receive the connecting rod 12. The connecting rod 12 follows a lateral path through the aperture 27 in the middle post 13, the connecting arms slots 4 and the middle casing 26 securing the three components while providing a pivot for the rotation of the actuator 1, as indicated in FIGS. 6 to 9 where the actuation axis is designated as L for reference. The middle post 13 is situated between the piezoelectric unit 10 and the fuel line 7 integrally formed with the top surface of the inner casing 15.

Figure 9:
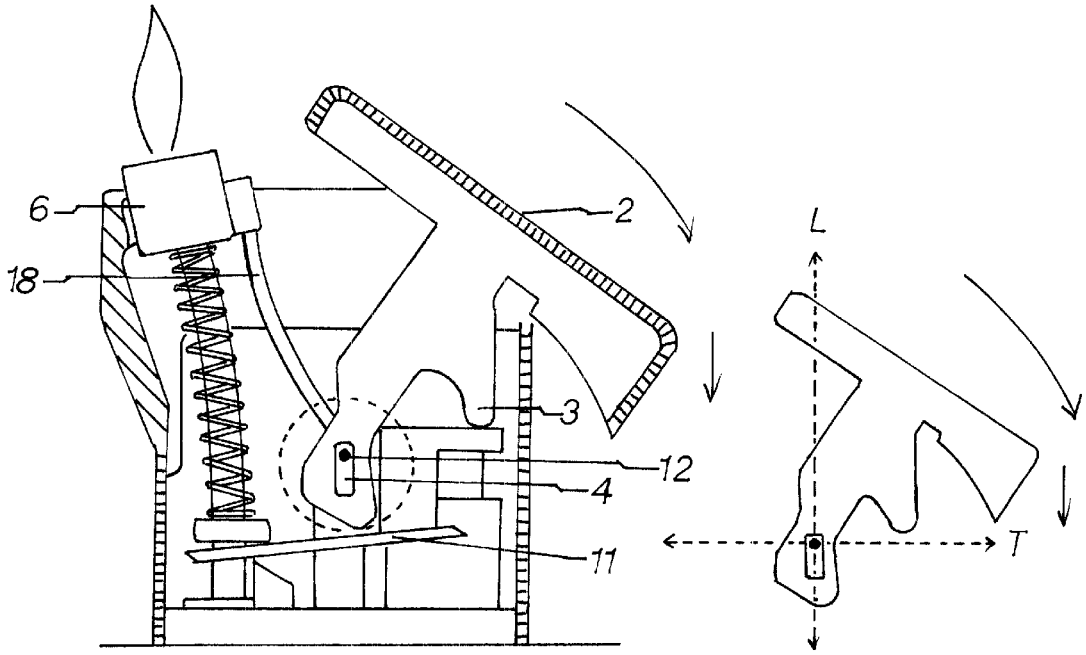
FIG. 9 is an enlarged partial cross-section view of a lighter with the present child-safe actuator showing the ignition of the lighter by the second displacement wherein the actuator has been depressed after the vertical alignment of the elongated slot, resulting in the connecting rod being at the top of the slot.

FIG. 2 also illustrates by means of a rear, perspective view the construction of the fuel reservoir 14 and its inner casing 15 and the fuel line 7 with the burner 6 on top and fuel line valve 8 just above the fuel reservoir 14. In some embodiments a coiled spring 30 wraps the fuel line, providing resistance to the gas lever 11 as it rotates upward to open the fuel valve 8, a bias which urges the gas lever 11 downward to its original position when pressure on the other end of the gas lever 11 relinquishes. FIG. 2 also shows the piezoelectric unit 10 which contains an outer telescopic member 10*a* and a smaller, inner telescopic member 10*b* on the upper portion of the piezoelectric unit 10 that telescopes into the larger, outer telescopic member 10*a*. A spark conductor 18 extends from the piezoelectric unit 10 to the burner 6. A spark is generated within the burner 6 when pressure on the piezoelectric cap 9 telescopes the piezoelectric unit 10 as illustrated in FIG. 9.

Figure 4:
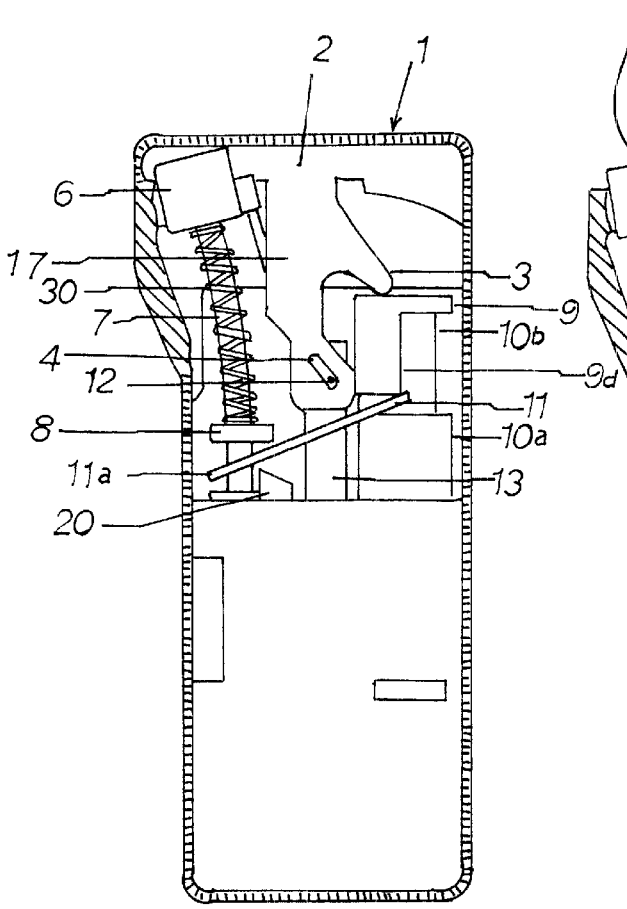
FIG. 4 is an enlarged cross section, longitudinal view, of the lighter in FIG. 1 in an inoperative, locked position, wherein the top cap is closed and the connecting rod is at the lower end of the angled, elongated slot.

FIG. 4 is a cross-section view of the lighter at rest and shows the smaller, inner piezoelectric unit 10*b* fitted with a piezoelectric unit cap 9. FIG. 2 illustrates a piezoelectric unit cap 9 that has a top surface 9*a* a distal end wall 9*b*, and two opposite walls 9*c* with flaps 9*d* extending downward which defines a cavity to receive the smaller, inner telescopic member of the piezoelectric unit 10*b*. As illustrated in FIG. 4, when the piezoelectric cap 9 is mounted on the inner piezoelectric unit member 10*b* the flaps 9*d* extend downward on both sides of the piezoelectric unit 10 to articulate with and engage the gas lever 11 in such manner that the gas lever 11 will be depressed if the inner piezoelectric unit member 10*b* is telescoped to generate an electric spark. When the actuator 1 is rearwardly rotated as a result of pressure on the top cap 2 as illustrated in FIGS. 5, 7, 8, 9, the finger projections 3 on the connecting arms 17 depress and telescopes the piezoelectric unit 10 thereby generating a spark in the burner 6 via the spark conductor 18.

Figure 5:
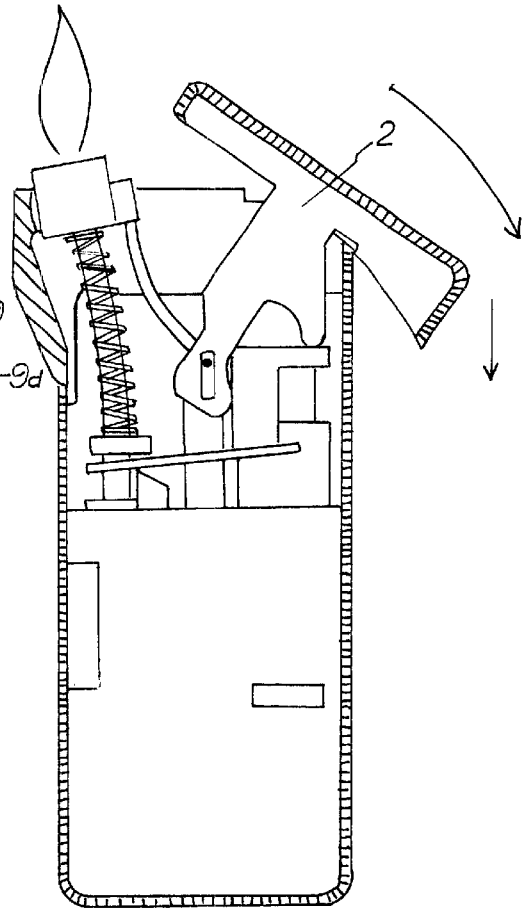
FIG. 5 is an enlarged cross section, longitudinal view, showing the top cap/child-safe actuator in a cocked, unlocked position, wherein the angled elongated slot of the connecting arm is perpendicular to the base of the lighter and the connecting rod is at the top of the elongated slot.

FIG. 5 is a cross-section of the lighter after sufficient force has been applied to the top cap 2 to complete the first and second displacements necessary for igniting the lighter. FIG. 5 illustrates how the rotation of the actuator 1 also causes the release of fuel into the burner 6 at the same time as a spark is generated in the burner 6 through the spark conductor 18. The downward force on the piezoelectric unit cap 9 generated by the rotation of the actuator 1 also causes the flaps 9*d* of the cap 9 to depress one end of the gas lever 11 downward, causing the opposite end of the gas lever 11*a*, fitted to the fuel line 7 beneath the fuel line valve 8, to pivot upward on the fulcrum post 20. This see-saw effect of the gas lever 11 causes a combustible fuel from the fuel reservoir 14 to release into the burner 6 through the fuel line 7 at the same time as a spark from the spark conductor occurs in the burner, resulting in a flame.

FIGS. 6 to 9 are partial cross-sections of a standard piezoelectric lighter fitted with the present child safe actuator 1 illustrating the operation of the present invention in sequence.

As depicted in FIG. 6, the actuator 1 is in an inoperative, locked position. In this position the connecting rod 12, which connects the connecting arms 17 through the middle post 13 and the middle casing 5 and which acts a pivot for the rotation of the actuator, is at the lower portion of the angled slot 4 in the connecting arms 17. Moreover, the slot 4 is not vertically aligned with the base of the lighter, but rests at an angle, making it impossible for a downward, perpendicular force to depress the piezoelectric cap 9 and initiate the ignition process. The enlarged illustration of the actuator 1 shows its orientation at the inoperative, locked stage of a lighter using the present invention.

FIGS. 7 and 8 are similar cross-sections depicting the lighter in FIG. 6 as force is applied to the top cap 2 and the first displacement of the actuator occurs. The first displacement occurs when the angled slots 4 in the connecting arms 17 are rotated to a vertical position as seen in FIGS. 5, 8 and 9, thereby unlocking and cocking the lighter for ignition by enabling the downward depression of the actuator.

FIGS. 8 and 9, illustrate the second displacement of the actuator as a downward force perpendicular to the base of the lighter is now applied to the top cap 2 in order to activate the ignition systems, i.e., the release of fuel into the burner 6 and the emission of an electric spark from the spark conductor 18 to ignite the fuel. However, it should be noted that the force applied to achieve the second displacement must be greater than that required for the first displacement because of the resistance supplied by the ignition systems. Moreover, if the force is discontinued at any point, the child-safe actuator reverts back to an inoperative mode as in FIGS. 4 and 6.

FIG. 9. depicts a partial cross-sectional view of the lighter using the present invention after the second displacement has occurred and ignition is complete. FIG. 9 shows the elongated slot 4 in the connecting arm in a vertical position and the connecting rod 12 at the top of the slot 4, while the top cap 2 has rotated using the connecting rod 12 as a pivot.

What is claimed is:

1. A piezoelectric lighter with a child resistant actuator, comprising:

an outer lighter casing enclosing an inner casing;

said inner casing containing a gas reservoir and a top plate disposed with a fuel dispensing assembly, a piezoelectric unit, and a middle post formed on the surface of said top plate;

a middle casing mounted on said outer casing, enclosing a burner and the upper parts of said fuel dispensing assembly and said piezoelectric unit, and connected to said outer casing by means of a connecting rod;

a child resistant actuator mounted on said middle casing, comprising:

a top cap with integrally formed connecting arms extending downward perpendicular to said top cap, with the free ends of said connecting arms defining an elongated aperture or connecting rod slot sized and configured to receive said connecting rod, and said connecting rod slot situated at an angle such that the axial movement of said actuator is limited until the angled connecting rod slot is rotated along the axis of said connecting rod to an actuation position vertical to the plane of said connecting rod, thereby permitting a further vertical depression of the actuator;

the connecting arms articulate with said piezoelectric unit and said fuel dispensing assembly so that the further depression of the actuator causes fuel to release into said burner and said piezoelectric unit to discharge an electric spark to ignite the fuel;

whereby said piezoelectric lighter is constructed and arranged such that the child resistant actuator engages the ignition systems only when a continuous force is applied to said top cap sufficient to cause a first displacement to unlock or cock the actuator by rotating it to an actuation position which allows the initiation of a second displacement to engage the ignition systems when force is continued to be applied to the top cap.

2. The lighter of claim 1 wherein said middle post is a solid structure defining an aperture or cavity sized to receive and thereby stabilize said connecting rod.

3. The lighter of claim 1 wherein said middle casing has two end walls and two opposite sidewalls with an aperture defined at the lower end of said sidewalls sized to receive said connecting rod, said aperture being aligned with said connecting arm slots and said middle post aperture or cavity so as to permit said connecting rod to traverse the same.

4. The lighter of claim 3 wherein said connecting rod traverses said middle casing via said connecting arm slots and said middle post aperture or cavity so as to serve as a pivot for the actuator.

* * * * *